US009329560B2

(12) United States Patent
Kuroda

(10) Patent No.: US 9,329,560 B2
(45) Date of Patent: May 3, 2016

(54) IMAGE FORMING APPARATUS, CONTROL METHOD FOR IMAGE FORMING APPARATUS, AND STORAGE MEDIUM FOR SWITCHING A POWER SOURCE OF A COOLING UNIT

(71) Applicant: CANON KABUSHIKI KAISHA, Tokyo (JP)

(72) Inventor: Yuji Kuroda, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 72 days.

(21) Appl. No.: 14/060,951

(22) Filed: Oct. 23, 2013

(65) Prior Publication Data

US 2014/0119766 A1 May 1, 2014

(30) Foreign Application Priority Data

Oct. 29, 2012 (JP) ..... 2012-237675

(51) Int. Cl.
*G03G 21/20* (2006.01)
*G03G 15/00* (2006.01)

(52) U.S. Cl.
CPC ..... *G03G 15/80* (2013.01); *G03G 21/206* (2013.01)

(58) Field of Classification Search
CPC ..... G03G 15/80
USPC ..... 399/92, 94, 406, 88
See application file for complete search history.

(56) References Cited

U.S. PATENT DOCUMENTS

2001/0023591 A1* 9/2001 Maeda et al.
2005/0235652 A1* 10/2005 Iwasaki
2007/0098432 A1* 5/2007 Mashiki ..... 399/88
2007/0188584 A1* 8/2007 Nakamura et al.
2011/0128698 A1* 6/2011 Nishioka et al.
2013/0205780 A1* 8/2013 Imran et al.

FOREIGN PATENT DOCUMENTS

JP 2008-052032 A 3/2008
JP 2009-224684 A 10/2009

* cited by examiner

*Primary Examiner* — Susan Lee
(74) *Attorney, Agent, or Firm* — Canon USA. Inc. IP Division

(57) ABSTRACT

An image forming apparatus for performing job processing includes a power supplying unit configured to supply power to a heating unit, a cooling unit configured to cool an inside of an enclosure of the image forming apparatus, a power generating unit configured to generate power by heat dissipated from the heating unit, a power storage unit configured to store the power generated by the power generating unit, and a power supply control unit configured to, after driving the cooling unit by the power from one of the power supplying unit and the power generating unit, switch a power source of the cooling unit from one of the power supplying unit and the power storage unit to the power generating unit.

7 Claims, 6 Drawing Sheets

IMAGE FORMING APPARATUS, CONTROL METHOD FOR IMAGE FORMING APPARATUS, AND STORAGE MEDIUM FOR SWITCHING A POWER SOURCE OF A COOLING UNIT

BACKGROUND OF THE INVENTION

1. Field of the Invention

The present invention relates to an image forming apparatus, a control method for the image forming apparatus, and a storage medium.

2. Description of the Related Art

Conventionally, image forming apparatuses are driven by power which is supplied from the outside of the apparatuses (i.e., power supplied from a commercial power source or a private electric generator).

Nowadays, in view of growing interest in global environmental issues and reducing running cost, various technologies which can contribute to saving energy are also developed for image forming apparatuses which use electrophotographic processes. According to some of these technologies, waste heat generated by the image forming apparatus or a component used in the apparatus is converted into electric energy and reused.

For example, in Japanese Patent Application Laid-Open No. 2008-052032 and Japanese Patent Application Laid-Open No. 2009-224684, techniques are discussed that convert heat dissipated from a fixing unit into power using a thermoelectric generating element arranged in the vicinity of the fixing unit.

The thermoelectric generating element uses a Seebeck element. The Seebeck element converts thermal energy directly into electrical power according to the Seebeck effect. When a temperature difference is caused to a thermoelectric conversion material including two different types of metals or a pair of a p-type semiconductor and an n-type semiconductor, a thermal electromotive force is produced at both junctions. It is distinguished characteristics that the Seebeck element does not require a driver such as a motor or a turbine and does not produce waste product.

Since the power generation of the Seebeck element is based on the temperature difference between a hot portion and a cold portion of one component (i.e., the opposite sides of one component), it is difficult to maintain the temperature difference and continue generating a predetermined power. This is because the heat is transmitted to the entire element, Thus, Japanese Patent Application Laid-Open No. 2008-052032 and Japanese Patent Application Laid-Open No. 2009-224684 discuss a method which can maintain the temperature difference between the hot and the cold portions of a thermoelectric generating element and efficiently generate power.

According to Japanese Patent Application Laid-Open No. 2008-052032, while one side of a thermoelectric generating element is arranged in the vicinity of an outer wall of an image forming apparatus, the other side is arranged to contact a heat transfer unit. The heat transfer unit transfers the heat of the fixing unit to the thermoelectric generating element.

Further, according to Japanese Patent Application Laid-Open No. 2009-224684, a blocking unit is arranged on the heating side of the thermoelectric generating element. The blocking unit blocks the conduction of the heat generated by a heat generating body to the cold side but conducts the heat generated by the heat generating body to the heating side.

However, even if a thermoelectric generating element is configured such that the temperature difference between the hot and the cold portions is maintained and power is efficiently generated as described above, still, there are the problems described below.

For example, if a unit on the load side, which operates by the power to be generated, is a cooling fan which cools the inside of the enclosure of the image forming apparatus and, if a large electromotive force is necessary when the cooling unit is started, the cooling fan may not operate normally. This is because since the temperature difference (i.e., power generation amount) of the thermoelectric generating element is small when power is turned on, the electrical energy which has been generated may be too small for the normal operation of the cooling fan.

SUMMARY OF THE INVENTION

The present invention is directed to a mechanism which can switch, after power is turned on and a cooling unit is normally driven, a power source of the cooling unit to a power source which generates power by heat dissipated from a power generating unit.

According to an aspect of the present invention, an image forming apparatus for performing job processing includes a power supplying unit configured to supply power to a heating unit, a cooling unit configured to cool an inside of an enclosure of the image forming apparatus, a power generating unit configured to generate power by heat dissipated from the heating unit, a power storage unit configured to store the power generated by the power generating unit, and a power supply control unit configured to, after driving the cooling unit by the power from one of the power supplying unit and the power generating unit, switch a power source of the cooling unit from one of the power supplying unit and the power storage unit to the power generating unit.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

<System Configuration>

Figure 1:
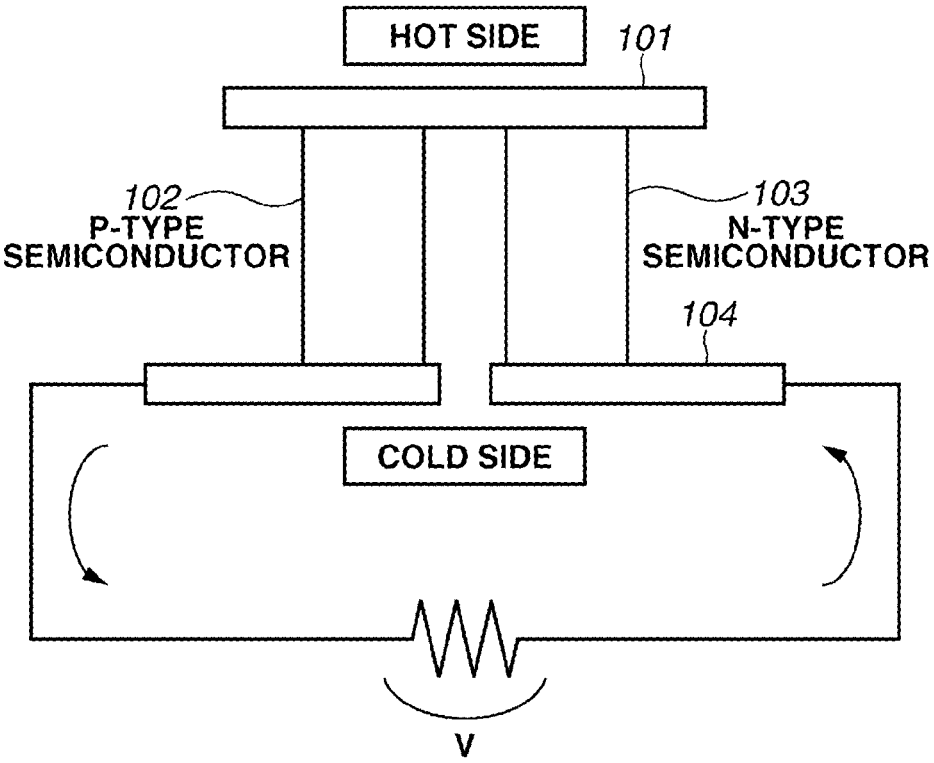
FIG. 1 is a conceptual drawing of a thermoelectric generating element.

A first exemplary embodiment will be described. FIG. 1 is a conceptual drawing of a thermoelectric generating element in an image forming apparatus. According to the present exemplary embodiment, the thermoelectric generating element uses the Seebeck effect. Further, according to the image forming apparatus of the present exemplary embodiment, when the apparatus is started, power is supplied to a cooling unit from a DC power supply. Then, when the cooling unit can stably cool the apparatus, the power source of the cooling unit is switched to a thermal power supply. The image forming apparatus according to the present exemplary embodiment controls each unit described below and performs various types of job processing (print processing, copy processing, scan processing, transmission processing, and BOX processing).

In FIG. 1, a metal (or a semiconductor) 101 and a metal (or a semiconductor) 104 are different types of metals (semiconductors). Due to the Seebeck effect, when either of the metal (or the semiconductor) 101 and the metal (or the semiconductor) 104 is connected and a temperature difference is generated between both sides, an electromotive force V is generated at a load resistor according to movement of the charges of a P-type semiconductor 102 and an N-type semiconductor 103. Accordingly, current flows in the direction indicated by the arrows illustrated in FIG. 1.

Thus, thermal energy can be converted into electric energy. There are various combinations of the materials used for the metals (or semiconductors) 101 and 104. The materials are not limited so long as the thermoelectric conversion can be performed. If the electromotive force generated by one thermoelectric generating element is not enough, a plurality of thermoelectric generating elements can be combined and used. The configuration of the thermoelectric generating element is not limited so long as the necessary thermoelectric conversion can be performed.

Figure 2:
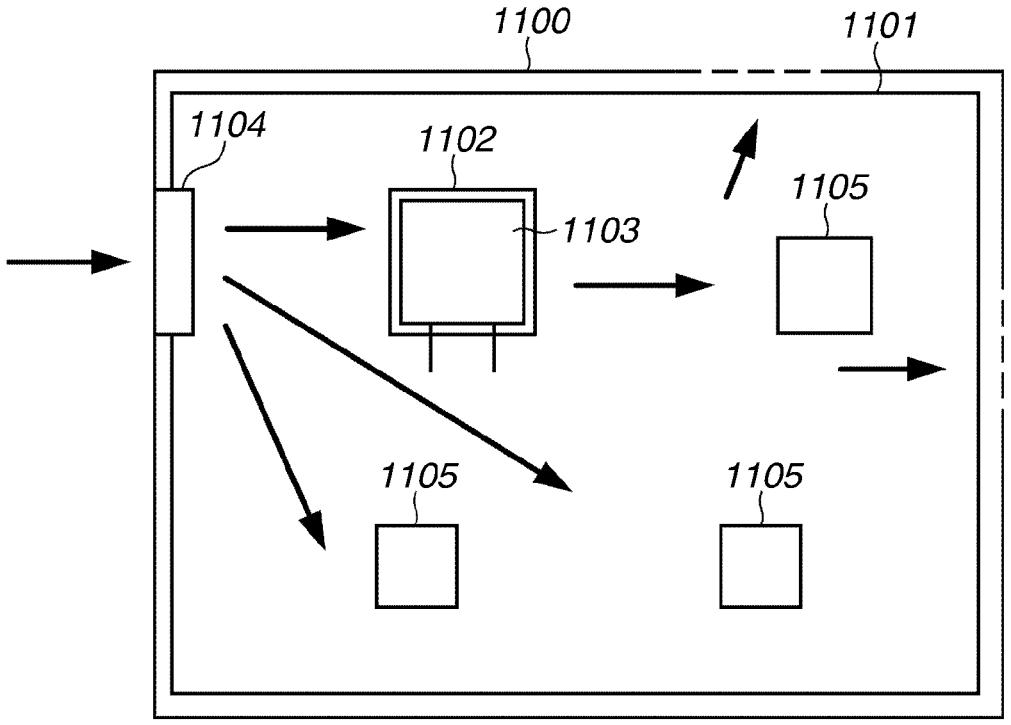
FIG. 2 is a conceptual drawing of an image forming apparatus using the thermoelectric generating element illustrated in FIG. 1.

FIG. 2 is a conceptual drawing of the image forming apparatus using the thermoelectric generating element illustrated in FIG. 1.

In FIG. 2, an image processing unit 1101 is set in the image forming apparatus. A box 1100 is made of sheet metal. The image processing unit 1101 is enclosed in the box 1100. A central processing unit (CPU) 1102 is a semiconductor which controls the entire image processing unit 1101. A large amount of heat is dissipated from the CPU 1102. The image processing unit 1101 also includes a thermoelectric generating element 1103. A cooling unit 1104 cools the inside of the box 1100, especially the inside of the enclosure of the image processing unit 1101. The heat dissipated by a group of semiconductors 1105 described below is not significant.

According to the present exemplary embodiment, the image processing unit 1101 is enclosed in the box 1100. The cooling unit 1104 cools the CPU 1102. The cooling unit 1104 takes in outside air and blows the air to each semiconductor as indicated by the arrows in FIG. 2. The warm air is exhausted from the box 1100 via a slit in the box 1100.

The image forming apparatus with the thermoelectric generating element 1103 uses the heat generated by the CPU 1102. Due to characteristics of the thermoelectric generating element 1103, the conversion efficiency of thermal energy to electric energy is enhanced according to the increase of the temperature difference between the hot and the cold areas.

According to the example in FIG. 2, although the thermoelectric generating element 1103 is mounted on the CPU 1102, the thermoelectric generating element 1103 can be arranged at any portion so long as the temperature difference between the cold and the hot areas can be ensured. Further, in addition to the CPU 1102, there are many units that generate heat (e.g., the fixing unit and a motor) in the image forming apparatus. However, since semiconductors including the CPU 1102 have a temperature constraint, the semiconductors are cooled by the heat generated by themselves with automatic control.

According to the first exemplary embodiment, the thermoelectric generating element 1103 receives the heat generated by the CPU 1102 and generates an electromotive force. If an electromotive force can be generated, the heat generated in the image forming apparatus may be used as the source of the electromotive force.

The description below is based on the assumption that thermal energy is supplied from the CPU 1102.

Figure 3:
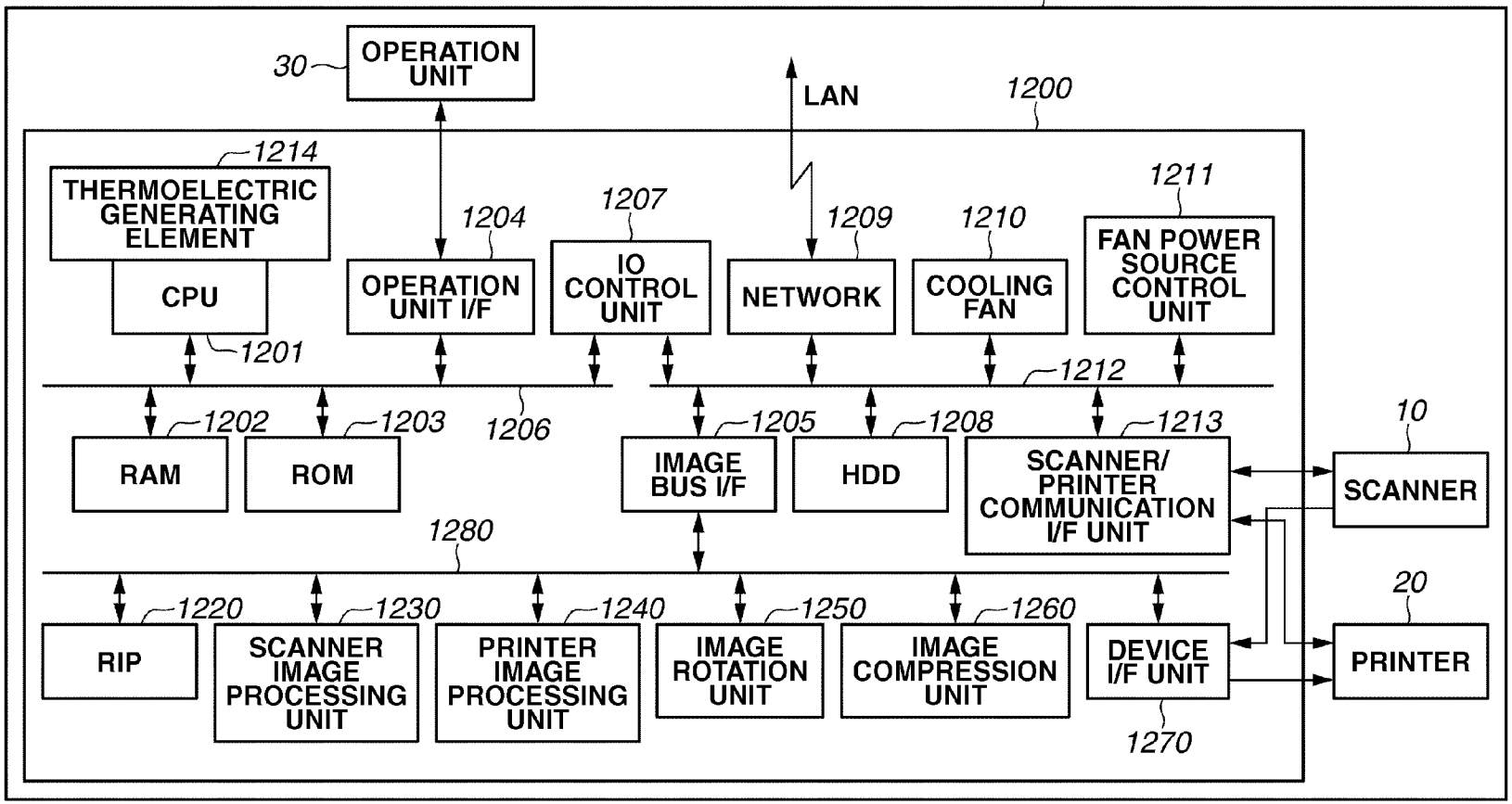
FIG. 3 is a block diagram illustrating an example of the image forming apparatus.

FIG. 3 illustrates a block diagram of the example of an image forming apparatus 100 according to the present exemplary embodiment. More precisely, FIG. 3 illustrates a configuration example of a controller unit 1200 which performs digital data processing of the image forming apparatus 100. The controller unit 1200 assumes a subjective role in the thermoelectric generation in a thermoelectric generating system. According to the present exemplary embodiment, the controller unit 1200 controls the units which perform the job processing. The units are, for example, a scanner 10, a printer 20, a hard disk drive (HDD) 1208, and a cooling fan 1210.

In FIG. 3, the controller unit 1200 is connected to the scanner 10 as an image reading unit and the printer 20 as an image output unit. Since the controller unit 1200 is connected to a local area network (LAN), it controls input/output of image information and information concerning communication control with external apparatuses and external units. Although not illustrated, the external apparatuses are a server and a personal computer (PC).

A CPU 1201 is a controller which controls the entire system. A random access memory (RAM) 1202 is a system work memory used for the operation of the CPU 1201. The RAM 1202 also serves as an image memory and temporarily stores image data. A read-only memory (ROM) 1203 is a boot ROM. A boot program of the system is stored in the ROM 1203.

An operation unit interface (I/F) unit 1204 interfaces with an operation unit 30. Image data to be displayed on the operation unit 30 is output to the operation unit 30 via the operation unit I/F unit 1204. Further, the operation unit I/F unit 1204 transmits information, which has been input by a user via the operation unit 30, to the CPU 1201. The above-described devices are connected to a system bus 1206.

An input-output (I/O) control unit 1207 controls each I/O chip and serves as an I/F to communicate with the CPU 1201 and the RAM 1202. The I/O control unit 1207 has a bus bridge function and connects the system bus 1206 and an I/O bus 1212.

The HDD 1208 stores system software, image data, and a software counter value. The software counter value is obtained to count up the number of output images. If the counter value can be stored in the power off state, the counter value is not necessarily stored in the HDD 1208. For example, the counter value may be stored in a non-volatile memory (not illustrated) or a memory for battery backup (not illustrated).

A network unit 1209 is connected to the LAN and performs input/output of various types of data associated with the images to be output as well as input/output of information associated with the control of the apparatus. By operating the operation unit 30, the user instructs the image forming apparatus 100 to receive image data to be output. Accordingly, the image data to be output is sent from a PC (not illustrated) on the network or an external apparatus (not illustrated) which manages data to be output. Then, the image is output from the apparatus.

Further, the cooling fan 1210 and a fan power source control unit 1211, which are characteristic of the present exemplary embodiment, are connected to the I/O bus 1212. The cooling fan 1210 functions as a cooling unit which cools the inside of the enclosure of the image forming apparatus 100.

A thermoelectric generating element 1214 is mounted on the CPU 1201. A scanner/printer communication I/F unit 1213 allows communication with a CPU of the scanner 10 as well as a CPU of the printer 20. The above-described units are connected to the IO bus 1212.

An image bus I/F unit 1205 is a bus bridge which converts data structure. The image bus I/F unit connects the I/O bus 1212 and an image bus 1280 which transfers image data at a high speed. Various devices and units are connected to the image bus 1280. A raster image processor (RIP) 1220 rasterizes a page-description language (PDL) code into a bitmap image.

A device I/F unit 1270 connects the scanner 10 and the printer 20, which are image input/output units, with the controller unit 1200 and performs synchronous/asynchronous conversion of image data. A scanner image processing unit 1230 corrects, processes, and edits the image data which has been input. A printer image processing unit 1240 corrects the printer and converts the resolution of the image data to be printed by the printer 20.

An image rotation unit 1250 rotates the image data. An image compression unit 1260 compresses/decompresses multivalued image data in a Joint Photographic Experts Group (JPEG) format and binary image data in a joint bi-level image experts group (JBIG), modified relative element address designate (MMR), or modified Huffman (MH) format.

Further, the image forming apparatus 100 is equipped with a sleep mode useful for saving power. The CPU 1201 controls the shift of the operation mode of the image forming apparatus to the sleep mode. In other words, the CPU 1201 determines the operation status of the image forming apparatus 100 and independently controls whether to block or supply power to the printer 20, the scanner 10, or the operation unit 30.

For example, if the user uses only the scanner function, power supply to the printer 20 and the printer image processing unit 1240 will be blocked. On the other hand, if the user uses only the printer function, power supply to unnecessary portions, such as the operation unit 30, the scanner 10, and the scanner image processing unit 1230, will be blocked so that the power consumption can be reduced.

Figure 4:
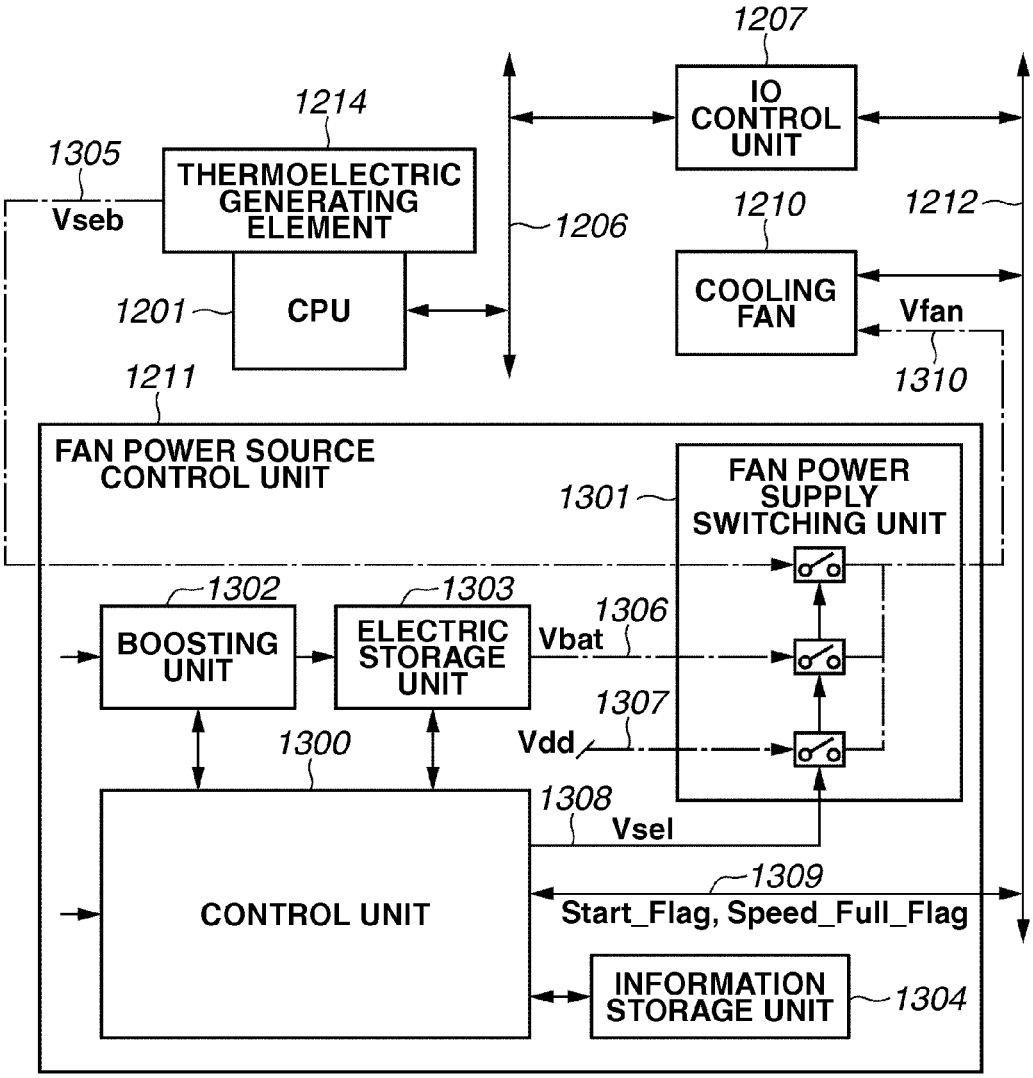
FIG. 4 is a block diagram illustrating details of a controller unit associated with the control of the thermoelectric generating element.

FIG. 4 is a detailed block diagram illustrating the thermoelectric generation control performed by the controller unit 1200 in the image forming apparatus 100 illustrated in FIG. 3.

The relation of the power supply system and the control signals of the CPU 1201, the I/O control unit 1207, the thermoelectric generating element 1214, and the cooling fan 1210 will be described with reference to the block diagram of the fan power source control unit 1211.

In FIG. 4, a control unit 1300, a fan power supply switching unit 1301, a boosting unit 1302, an electric storage unit 1303, and an information storage unit 1304 are arranged in the fan power source control unit 1211.

The control unit 1300 is a controller which controls the switching of the input power source of the cooling fan 1210 at necessary timing and performs the entire control of the fan power source control unit 1211. According to a selection condition provided by the control unit 1300, the fan power supply switching unit 1301 switches the power for the cooling fan 1210. More precisely, the fan power supply switching unit 1301 switches the power for the cooling fan 1210 from among the power output from the thermoelectric generating element 1214, storage power from the electric storage unit 1303, and the power from the DC power supply, and supplies the switched power to the cooling fan 1210. The electric storage unit 1303 stores the power generated by the thermoelectric generating element 1214. when the power generated by the thermoelectric generating element 1214 is stored in the electric storage unit 1303, the power has been boosted by the boosting unit 1302.

The boosting unit 1302 boosts the voltage output from the thermoelectric generating element 1214. The electric storage unit 1303 is a secondary battery such as a lithium ion battery and stores the power boosted by the boosting unit 1302. The thermoelectric generating element 1214 functions as a power generating unit which converts the heat dissipated by the CPU 1201 into electric energy.

The information storage unit 1304 stores switching conditions of the input power source for the cooling fan 1210 as well as switching triggers (e.g., voltage threshold value, temperature difference of the thermoelectric generating element 1214, timer output) for the cooling fan 1210.

Further, a voltage Vseb 1305 is generated by the thermoelectric generating element 1214, a voltage Vbat 1306 is a storage power amount of the electric storage unit 1303, and a voltage Vfan 1310 is an input voltage of the cooling fan 1210. These voltages are the power supply voltages.

Additionally, a control signal Vsel 1308 is a selection signal used for switching the power supply for the cooling fan 1210. A communication bus 1309 connects the I/O control unit 1207 and the control unit 1300. Especially, according to the first exemplary embodiment, control/status signals such as a Start_Flag signal and a Speed_Full_Flag signal are transmitted via the communication bus 1309. The Start_Flag signal indicates the start of the controller unit 1200 and the return from the power saving mode. The Speed_Full_Flag signal indicates the switch of the mode of the cooling fan 1210 to the full speed mode.

Figure 5:
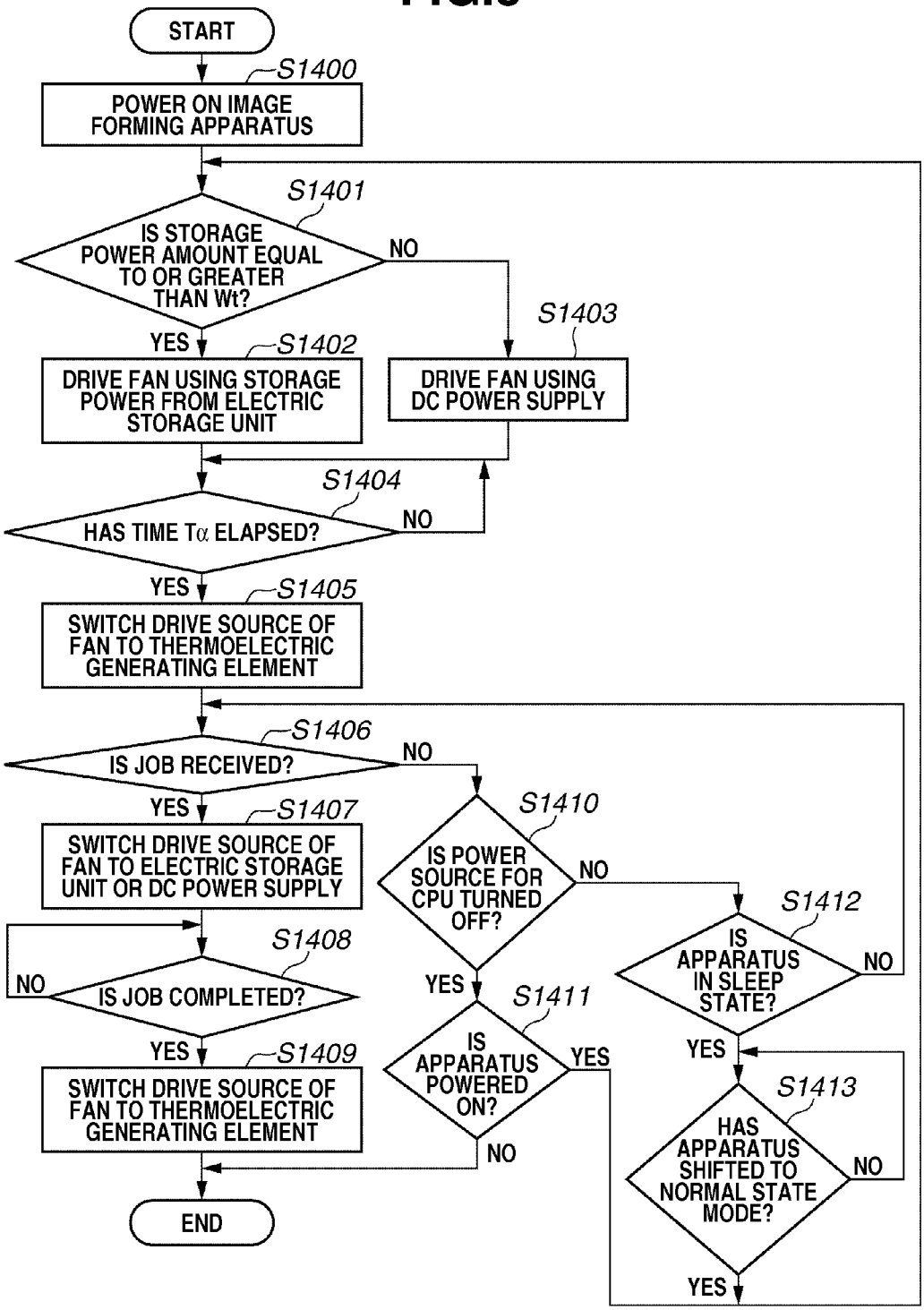
FIG. 5 is a flowchart illustrating a control method for the image forming apparatus.

FIG. 5 is a flowchart illustrating a control method for the image forming apparatus 100 according to the present exemplary embodiment. More precisely, FIG. 5 is a flowchart illustrating an example of thermoelectric generation processing using the thermoelectric generating element 1214 in the controller unit 1200. Each step of the flowchart is realized by the control unit 1300 executing a control program stored in the ROM 1203. According to the flowchart, whether the power supply to the cooling fan 1210 can be switched is determined according to whether the cooling fan 1210 can be driven by the power amount supplied from the electric storage unit 1303 (first determination processing).

In step S1400, the image forming apparatus 100 is powered on and the fan power source control unit 1211 transfers a Start_Flag signal from the I/O control unit 1207 to the control unit 1300 via the IO bus 1212 and the communication bus 1309.

In S1401, after recognizing the Start_Flag signal, the control unit 1300 compares the amount of storage power from the electric storage unit 1303 and a minimum power amount Wt, which is necessary for starting the fan one time, (stored in the information storage unit 1304) and determines whether the cooling fan 1210 can be driven by the amount of storage power from the electric storage unit 1303. If the control unit 1300 determines that the power amount of the electric storage unit 1303 is equal to or greater than the power amount Wt (YES in step S1401), the processing proceeds to step S1402. In step S1402, the control unit 1300 selects the voltage Vbat 1306 (storage power amount of the electric storage unit 1303) for the input power source of the voltage Vfan 1310 of the cooling fan 1210, outputs thereto, and drives the cooling fan 1210 using the power stored in the electric storage unit 1303.

On the other hand, in step S1401, if the control unit 1300 determines that the power amount of the electric storage unit 1303 is less than the power amount Wt (NO in step S1401), the processing proceeds to step S1403. In step S1403, by the control signal Vsel 1308, the control unit 1300 causes the fan power supply switching unit 1301 to select a voltage Vdd 1307, supplies the voltage Vdd 1307 from the DC power supply, and drives the cooling fan 1210.

In step S1404, the control unit 1300 measures and determines whether time Tα (stored in the information storage unit 1304) has elapsed using a timer (not illustrated). If the time Tα has elapsed (YES in step S1404), the processing proceeds to step S1405. If the time Tα has not yet elapsed (NO in step S1404), step S1404 is repeated. In step S1405, the control unit 1300 switches the input power source of the voltage Vfan 1310 of the cooling fan 1210 from the voltage Vbat 1306 or the voltage Vdd 1307 to the voltage Vseb 1305 (power generated by the thermoelectric generating element 1214).

In step S1406, the control unit 1300 determines whether a job, such as a print job, is received. If the job is executed, since the heat dissipation of the CPU 1201 is increased, full speed operation of the cooling fan 1210 becomes necessary. In such a case, the fan power source control unit 1211 receives the Speed_Full_Flag signal from the I/O control unit 1207 via the IO bus 1212 and the communication bus 1309. If the control unit 1300 determines that a job is received (YES in step S1406), the processing proceeds to step S1407.

In step S1407, after receiving the Start_Flag signal, the control unit 1300 changes the value of the control signal Vsel 1308 to be output to the fan power supply switching unit 1301 so that the voltage Vbat 1306 or the voltage Vdd 1307 is input in the input power source of the voltage Vfan 1310 of the cooling fan 1210.

In step S1408, the control unit 1300 determines whether the job is finished. If the job is finished (YES in step S1408), the processing proceeds to step S1409. If the job is not yet finished (NO in step S1408), step S1408 is repeated. In step S1409, again, the control unit 1300 switches the input power source of the voltage Vfan 1310 of the cooling fan 1210 from the voltage Vbat 1306 or the voltage Vdd 1307 to the voltage Vseb 1305 (power generated by the thermoelectric generating element 1214). Then, the processing ends.

On the other hand, in step S1406, if the control unit 1300 determines that the job is not yet received (NO in step S1406), the processing proceeds to step S1410. In step S1410, the control unit 1300 determines whether the power source that supplies power to the CPU 1201 is turned off. If the control unit 1300 determines that the power source that supplies power to the CPU 1201 is turned off (YES in step S1410), the processing proceeds to step S1411. In step S1411, the control unit 1300 determines whether the image forming apparatus 100 is powered ON. If the control unit 1300 determines that the image forming apparatus 100 is shifted to a power-ON state (YES in step S1411), the processing returns to step S1401. If the control unit 1300 determines that the image forming apparatus 100 is powered OFF (NO in step S1411), then the processing ends.

On the other hand, in step S1410, if the control unit 1300 determines that the image forming apparatus 100 is powered ON (NO in step S1410), the processing proceeds to step S1412. In step S1412, the control unit 1300 determines whether the power supply is shifted from a normal state to a power saving state(sleep state). If the control unit 1300 determines that the image forming apparatus 100 is not shifted to the sleep state (NO in step S1412), the processing returns to step S1406. If the control unit 1300 determines that the apparatus is shifted to the sleep state (YES in step S1412), the processing proceeds to step S1413. In step S1413, the control unit 1300 determines whether the image forming apparatus 100 is shifted to the normal state mode from the sleep state (return from the sleep). If the control unit 1300 determines that the apparatus is shifted to the normal state mode (YES in step S1413), the processing returns to step S1401, and the processing of step S1402 and subsequent steps is repeated. If the control unit 1300 determines that the image forming apparatus 100 has not yet shifted to the normal state mode (NO in step S1413), step S1413 is repeated.

In this manner, the power of the image forming apparatus as a whole is saved by the switching of the power source of the cooling fan 1210 among the power supplied from the electric storage unit (voltage Vbat), the power supplied from the main body (voltage Vdd), and the power supplied from the thermoelectric generating element (voltage Vseb). In addition, when the image forming apparatus is started, the power is supplied from the electric storage unit (voltage Vbat) or the power supplied from the main body (voltage Vdd) in place of the power supplied from the thermoelectric generating element (voltage Vseb). Thus, the cooling fan 1210 can be operated with reliability.

Figure 6:
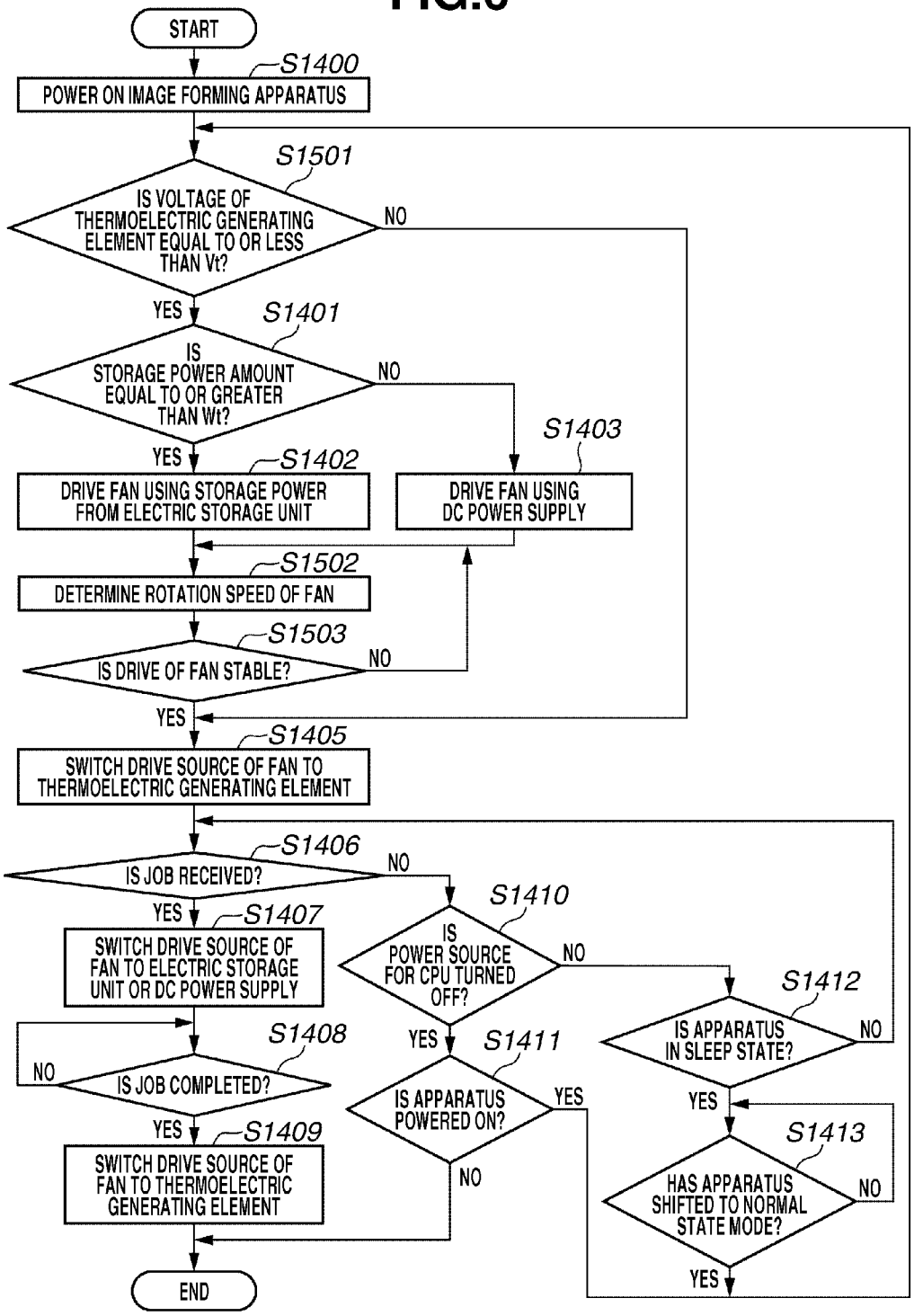
FIG. 6 is a flowchart illustrating a control method for the image forming apparatus.

FIG. 6 is a flowchart illustrating a control method for the image forming apparatus according to a second exemplary embodiment of the present invention. An example of the thermoelectric generation processing using the thermoelectric generating element 1214 in the controller unit 1200 will be described with reference to FIG. 6. Each step of the flowchart is realized by the control unit 1300 executing a control program stored in the ROM 1203. The processing in FIG. 6 is similar to the processing illustrated in FIG. 5 except that processing for determining whether the operation of the cooling fan 1210 is stably performed is added. In the following description, the steps different from those described with reference to FIG. 5 according to the first exemplary embodiment are mainly described. According to the present exemplary embodiment, the power supplied to the cooling fan 1210 is switched based on determination processing (second determine processing) for determining whether the cooling fan 1210 can be driven by the power amount which can be supplied from the thermoelectric generating element 1214 or the electric storage unit 1303.

In step S1400, the image forming apparatus 100 is powered on. In step S1501, the control unit 1300 determines whether the voltage level of the voltage Vseb 1305, which is generated by the thermoelectric generating element 1214, is equal to or less than a threshold value voltage Vt. If the control unit 1300 determines that the voltage Vseb 1305 is equal to or less than the threshold value voltage Vt stored in the information storage unit 1304 (YES in step S1501), the processing proceeds to step S1401. In step S1401, the controller unit 1300 compares and determines whether the power amount stored in the electric storage unit 1303 is equal to or greater than the power amount Wt. If the power amount stored in the electric storage unit 1303 is equal to greater than the power amount Wt (YES in step S1401), the processing proceeds to step S1402. If the power amount stored in the electric storage unit 1303 is less than the power amount Wt (NO in step S1401), the processing proceeds to step S1403. In steps S1402 and S1403, the input power supply of the voltage Vfan 1310 of the cooling fan 1210 operates by the voltage Vbat 1306 or the voltage Vdd 1307.

In this manner, the control unit 1300 executes the processing in steps S1402 and S1403. Then, in step S1502, the control unit 1300 determines the rotation speed of the cooling fan 1210. In step S1503, the control unit 1300 determines whether the operation of the cooling fan 1210 is stably performed.

According to the present exemplary embodiment, in step S1502, the control unit 1300 determines the rotation speed of the cooling fan 1210 as follows. The control unit 1300 determines the rotation speed according to the voltage level of the input power source of the voltage Vfan 1310 of the cooling fan 1210 or an operation status (not illustrated) of the cooling fan 1210. In step S1503, the control unit 1300 determines whether the operation of the cooling fan 1210 is stably performed. The control unit 1300 determines whether the fan operation is stably performed by comparing the voltage level of the input power source of the voltage Vfan 1310 with the threshold value voltage Vt stored in the information storage unit 1304. Thus, in step S1503, the control unit 1300 can determine the cooling state of the cooling fan 1210 based on the power supplied in steps S1402 and S1403.

If the control unit 1300 determines that the fan operation is stably performed (YES in step S1503), the processing proceeds to step S1405. If the control unit 1300 determines that the fan operation is not stably performed (NO in step S1503), the processing of step S1502 and step S1503 is repeated. In step S1405, since the rotation of the fan is stable, the control unit 1300 switches the input power source of the voltage Vfan 1310 of the cooling fan 1210 from the voltage Vbat 1306 or the voltage Vdd 1307 to the voltage Vseb 1305 (power generated by the thermoelectric generating element 1214). Since other steps are similar to those described with reference to FIG. 5, their descriptions are not repeated.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-237675 filed Oct. 29, 2012, which is hereby incorporated by reference herein in its entirety.

What is claimed is:

1. An image forming apparatus for performing job processing, the image forming apparatus comprising:

a cooling unit configured to cool an inside of an enclosure of the image forming apparatus;

a heating unit arranged inside of the enclosure of the image forming apparatus;

a power generating unit configured to generate power by heat of the heating unit;

an external power source configured to store the power generated by the power generating unit;

a power supply control unit configured to supply power to the cooling unit from the external power source when the cooling unit starts, after the cooling unit starts by the power from the external power source, switch a power source of the cooling unit from the external power source to the power generating unit when a predetermined time elapses;

a first determination unit configured to determine whether the cooling unit is capable of being driven by a power amount suppliable from the external power source, wherein, if the first determination unit determines that the cooling unit is capable of being driven by the power amount suppliable from the external power source, the power supply control unit switches the power source of the cooling unit from the external power source to the power generating unit according to a time elapsed from when the cooling unit has been driven by the power from the external power source, and wherein, if the first determination unit determines that the cooling unit is incapable of being driven by the power amount suppliable from the external power source, the power supply control unit switches the power source of the cooling unit from the power supplying unit to the power generating unit according to the time elapsed from when the cooling unit has been driven by the power from the power supplying unit; and a second determination unit configured to determine whether the cooling unit is capable of being driven by a power amount suppliable from one of the power generating unit and the external power source, wherein, if the second determination unit determines that the cooling unit is incapable of being driven by the power amount suppliable from the power generating unit and the cooling unit is capable of being driven by the power amount suppliable from the external power source, after the cooling unit has been driven by the power from the external power source, the power supply control unit switches the power source of the cooling unit from the external power source to the power generating unit according to a cooling state of the cooling unit, and wherein, if the second determination unit determines that the cooling unit is incapable of being driven by the power amount suppliable from one of the power generating unit and the external power source, after the cooling unit has been driven by the power from the power supplying unit, the power supply control unit switches the power source of the cooling unit from the power supplying unit to the power generating unit according to the cooling state of the cooling unit.

2. The image forming apparatus according to claim 1, further comprising a receiving unit configured to receive a job, wherein the power supply control unit switches the power source of the cooling unit from the power generating unit to the external power source.

3. The image forming apparatus according to claim 1, wherein the cooling unit is a cooling fan which exhausts heat of the inside of the enclosure.

4. The image forming apparatus according to claim 1, wherein the heating unit is a CPU which controls the image forming apparatus.

5. The image forming apparatus according to claim 4, the power generating unit is mounted on the CPU.

6. A control method for an image forming apparatus cooling, by a cooling unit, an inside of an enclosure of the image forming apparatus;

generating power, by a power generating unit, by heat of a heating unit arranged inside of the enclosure of the image forming apparatus;

storing the power generated by the power generating unit in an external power source;

supplying power to the cooling unit from the external power source when the cooling starts, after the cooling starts by the power from the external power source, switch a power source of the cooling unit from the external power source to the power generating unit when a predetermined time elapses;

determining whether the cooling unit is capable of being driven by a power amount suppliable from the external power source, wherein, if the determining determines that the cooling unit is capable of being driven by the power amount suppliable from the external power source, the supplying power switches the power source of the cooling unit from the external power source to the power generating unit according to a time elapsed from when the cooling unit has been driven by the power from the external power source, and wherein, if determining determines that the cooling unit is incapable of being driven by the power amount suppliable from the external power source, the power supply control unit switches the power source of the cooling unit from the power supplying unit to the power generating unit according to the time elapsed from when the cooling unit has been driven by the power from the power supplying unit; and determining whether the cooling unit is capable of being driven by a power amount suppliable from one of the power generating unit and the external power source, wherein, if the determining determines that the cooling unit is incapable of being driven by the power amount suppliable from the power generating unit and the cooling unit is capable of being driven by the power amount suppliable from the external power source, after the cooling unit has been driven by the power from the external power source, the power supply control unit switches the power source of the cooling unit from the external power source to the power generating unit according to a cooling state of the cooling unit, and wherein, if the determining determines that the cooling unit is incapable of being driven by the power amount suppliable from one of the power generating unit and the external power source, after the cooling unit has been driven by the power from the power supplying unit, the power supply control unit switches the power source of the cooling unit from the power supplying unit to the power generating unit according to the cooling state of the cooling unit.

7. A non-transitory computer-readable storage medium storing a program that causes a computer to execute the control method for the image forming apparatus according to claim 6.

* * * * *